US010486122B2

(12) United States Patent
Hirth

(10) Patent No.: US 10,486,122 B2
(45) Date of Patent: Nov. 26, 2019

(54) FLUID MIXER WITH TOUCH-ENABLED GRAPHICAL USER INTERFACE, AUTO FLUSH-OUT, MANAGEMENT REPORTING, AND LOGGING

(71) Applicant: Yvette Seifert Hirth, San Francisco, CA (US)

(72) Inventor: Yvette Seifert Hirth, San Francisco, CA (US)

( * ) Notice: Subject to any disclaimer, the term of this patent is extended or adjusted under 35 U.S.C. 154(b) by 764 days.

(21) Appl. No.: 15/013,871

(22) Filed: Feb. 2, 2016

(65) Prior Publication Data

US 2017/0216797 A1 Aug. 3, 2017

(51) Int. Cl.
*B01F 15/00* (2006.01)
*B01F 13/10* (2006.01)
*B01F 15/04* (2006.01)

(52) U.S. Cl.
CPC .... *B01F 15/00253* (2013.01); *B01F 13/1066* (2013.01); *B01F 15/00155* (2013.01); *B01F 15/00175* (2013.01); *B01F 15/00233* (2013.01); *B01F 15/00376* (2013.01); *B01F 15/00396* (2013.01); *B01F 15/00409* (2013.01); *B01F 15/00422* (2013.01); *B01F 15/0408* (2013.01)

(58) Field of Classification Search
CPC ..... B01F 13/1066; B01F 15/00155; B01F 15/00175; B01F 15/00233; B01F 15/00253; B01F 15/00376; B01F 15/00396; B01F 15/00409; B01F 15/00422; B01F 15/0408
See application file for complete search history.

(56) References Cited

U.S. PATENT DOCUMENTS

2003/0223909 A1* 12/2003 Oberbeck ..... B01F 5/0604 422/606
2005/0284886 A1* 12/2005 Penciu ..... B01F 13/1058 222/145.6
2006/0013729 A1* 1/2006 Carey ..... B01F 9/0001 422/63
2006/0231259 A1* 10/2006 Dykstra ..... B01F 13/1013 166/305.1
2006/0233039 A1* 10/2006 Dykstra ..... B01F 15/00207 366/8
2008/0028988 A1* 2/2008 Welker ..... B01F 3/04446 106/316
2008/0165612 A1* 7/2008 Dykstra ..... B01F 15/00207 366/8

(Continued)

*Primary Examiner* — Tony G Soohoo
(74) *Attorney, Agent, or Firm* — Christopher Peil; Law Office of Christopher Peil

(57) ABSTRACT

A "fluid mixer" device that automates the mixing of multiple fluids into a base liquid and the delivery of the mixed liquid according to user-specified parameters with automatic flush-out, full logging and reporting capabilities. The device is comprised of a plurality of modules, each of which is designed for a different environmental setting: (a) the control module, the module with which the user interfaces, is normally located in a dry area, away from both line voltage electricity and fluids; (b) the power module, which supplies power to all modules, is located near 110 V-230 V single phase line voltage, and thus contains all of the high-voltage gear and interfaces; and (c) the flow module, the bank of controlled liquid mixers, is located in the wet area and uses only low-voltage direct current in its operation.

13 Claims, 21 Drawing Sheets

(56) References Cited

U.S. PATENT DOCUMENTS

| | | | | |
|---|---|---|---|---|
| 2008/0165613 | A1* | 7/2008 | Dykstra | B01F 15/00207 366/17 |
| 2008/0264641 | A1* | 10/2008 | Slabaugh | B01F 3/0861 166/308.2 |
| 2009/0325276 | A1* | 12/2009 | Battrell | B01F 11/0071 435/287.2 |
| 2010/0024915 | A1* | 2/2010 | Thomas | A47L 13/50 141/69 |
| 2010/0172202 | A1* | 7/2010 | Borgstadt | B01F 13/1013 366/15 |
| 2010/0181340 | A1* | 7/2010 | Wallace | A45D 19/00 222/144.5 |
| 2010/0239708 | A1* | 9/2010 | Bachman | A01K 5/00 426/2 |
| 2011/0041952 | A1* | 2/2011 | Gaultney | B01F 13/1005 141/83 |
| 2013/0043164 | A1* | 2/2013 | Hatten | C10G 21/30 208/178 |
| 2016/0016128 | A1* | 1/2016 | Cink | A01M 1/2038 366/138 |
| 2016/0199831 | A1* | 7/2016 | Codisco | A61M 1/0281 435/325 |
| 2017/0197188 | A1* | 7/2017 | Gunia | B01F 3/0853 |
| 2017/0216797 | A1* | 8/2017 | Hirth | B01F 13/1066 |
| 2017/0281822 | A1* | 10/2017 | Becker | B05B 7/2416 |
| 2018/0008739 | A1* | 1/2018 | Ditzler | A61L 2/183 |

* cited by examiner

FLUID MIXER WITH TOUCH-ENABLED GRAPHICAL USER INTERFACE, AUTO FLUSH-OUT, MANAGEMENT REPORTING, AND LOGGING

BACKGROUND

Technical Field

The present device relates to the precise mixing of a base fluid with additional fluids to produce a resultant mixed fluid with a prespecified temperature, oxygenation, additional fluid density, and pH.

Background

Devices to assist in the process of mixing liquids have a long history in the art. From hand-held stirring devices to blenders, liquid mixers come in all shapes and sizes.

Who mixed the first liquids and what tools they used are not known. In modern times, liquid mixers are typically comprised of a motor and a liquid-turning element, such as a propeller or other mixing "blade(s)". These liquid mixers are usually used to mix solids into liquids, though some are designed for mixing liquids into liquids. None have been found that are computer-controlled, nor have any been found that run according to one or more schedules synchronized with real-time.

SUMMARY

A "fluid mixer" device that automates the mixing of multiple fluids into a base liquid and the delivery of the mixed liquid according to user-specified parameters with automatic flush-out, full logging and reporting capabilities. The device is comprised of a plurality of modules, each of which is designed for a different environmental setting: (a) the control module, the module with which the user interfaces, is normally located in a dry area, away from both line voltage electricity and fluids; (b) the power module, which supplies power to all modules, is located near 110V-230V single phase line voltage, and thus contains all of the high-voltage gear and interfaces; and (c) the flow module, the bank of controlled liquid mixers, is located in the wet area and uses only low-voltage direct current in its operation.

Liquid mixers offer a wide range of usability, from mixing large tanks of drinkable solutions such as tea to complex chemical solutions. The present device is digitally-based, using both microprocessor and microcontroller technology, and can address the needs of all users. Up to 255 different mixing processes can each begin at any user-specified time of day, and up to 255 delivery processes can each begin at any user-specified time of day. The number of mixing processes and delivery processes does not have to be the same.

The device also controls water heaters, mixing pumps, aerator pumps for oxygenated mixed fluids, as well as optional delivery pumps for non-gravity-feed installations. The device logs the actions taken along with the then-current clock setting in nonvolatile memory and then displays them in a zoomable, viewable format so as to focus on the actions taken and results achieved either by zooming in to focus on a given day, or zooming out to shift the focus to longer time periods.

BRIEF DESCRIPTION OF THE DRAWINGS

Various other objects, features, and attendant advantages of the present device will become more fully appreciated as the same becomes better understood when considered in conjunction with the accompanying drawings, in which like reference characters designate the same or similar parts throughout the several views, and wherein.

DEFINITIONS

Figure 1:
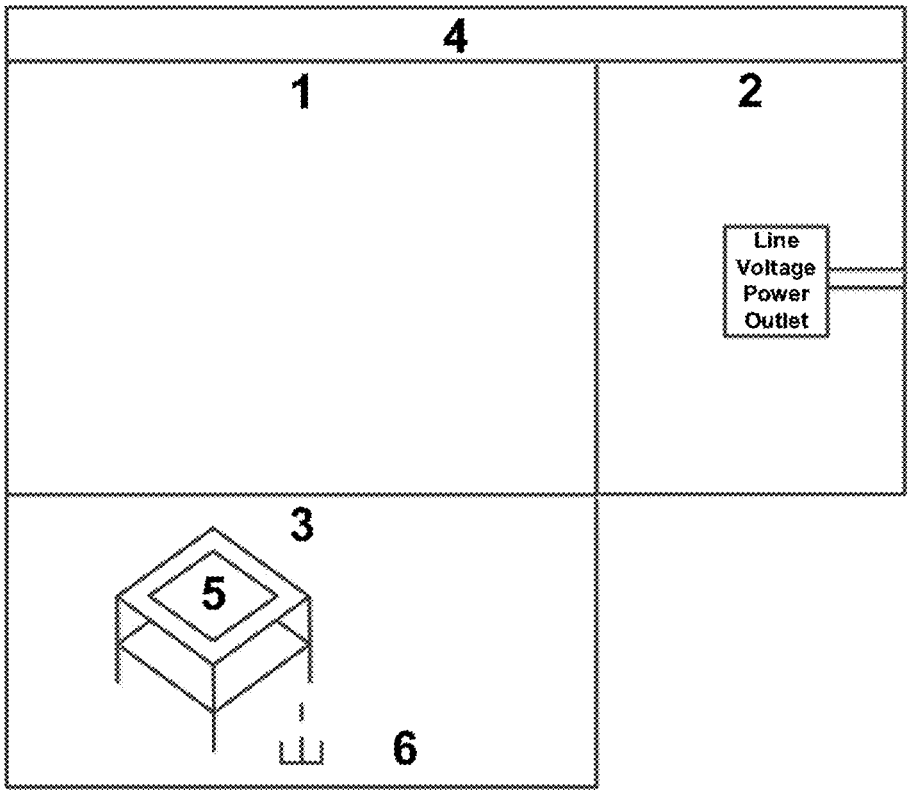
FIG. 1 shows a sample mixing/delivery environment.

"Base fluid" shall be defined as the fluid, normally water, that is contained within the tank as further defined below into which all the fluids being mixed are injected;

"Bin" shall be defined as the combination of one fluid container and all of that one container's associated plumbing components holding a fluid to be mixed;

"CPU" shall be defined as either a microprocessor, or a microcontroller, or a programmable logic controller, or as some combination of one or more of the above-listed components in a configuration that will run software program instructions;

"Delivery tube" shall be defined as the combination of the solenoid-controlled valve, the second union and the spray drain cap. There is one delivery tube per bin;

"Disk" shall be defined as the solid-state disk drive(s) of any form factor, including microSD cards, SD cards, compact flash cards, et al, that is mounted on the printed circuit board or otherwise inside the device and is/are thus included within the device;

"Event" shall be defined as any action taken with respect to the liquid in the bins or the base/mixed liquid in the tank;

"Mixed fluid" shall be defined as the base fluid in the tank plus any injectables that have been previously mixed in with the base fluid;

"Non-volatile memory" shall be defined as either the electronically erasable programmable rewriteable memory contained within the CPU or otherwise within the device, for example, EEPROM or FLASH memory;

"Powcom" shall be defined as either or both of the two multi-conductor cables which run between both the power and control modules and the power and flow modules. The powcom cables perform both a power-supply function, supplying various DC voltages, as well as supporting a communications function, supplying communications wiring carrying the various signals and data that are serially-transmitted between the components;

"Read from disk" shall be defined as the combination of software commands that initiate the read command(s) to the disk and wait for it/them to complete;

"Read from nonvolatile" shall be defined as the combination of software commands that initiate the read command to EEPROM or FLASH and wait for it to complete;

"Tank" shall be defined as the holding container for the base fluid, be it a holding tank, reservoir, pool, or other storage medium;

"Vendor" shall be defined as any manufacturer of CPU devices;

"Write to disk" shall be defined as the combination of software commands that initiate the read and write command(s) to the disk and wait for it/them to complete; and "Write to nonvolatile" shall be defined as the combination of software commands that initiate the write command to EEPROM or Flash and wait for it to complete.

DETAILED DESCRIPTION

A "fluid mixer" device that automates the mixing of multiple fluids into a base liquid and the delivery of the mixed liquid according to user-specified parameters with automatic flush-out, full logging and reporting capabilities. The device is comprised of three modules, each of which is designed for a different environmental setting: (a) the control module, the module with which the user interfaces, is normally located in a dry area, away from both line voltage electricity and fluids; (b) the power module, which supplies power to all three modules, is located near 110V-230V single phase line voltage, and thus contains all of the high-voltage gear and interfaces; and (c) the flow module, the bank of controlled liquid mixers, is located in the wet area and uses only low-voltage direct current in its operation.

In combination with the attached drawings, the technical contents and detailed description of the present device are described hereinafter according to a number of embodiments, but should not be used to limit its scope.

In FIG. 1 a typical fluid mixing environment is shown. There are three distinct areas shown: 1 is a dry area on the wall 4 with no line voltage, 2 is a dry area on the wall 4 with line voltage, and 3 is a wet area away from the wall 4 that houses the tank 5 and drain 6. 3 is thus a "wet area" where line voltage should not be present due to the risk of shock. The control module is designed for area 1 as it contains only low-voltage DC components that are required to stay dry, the device's power module is designed for area 2 as it contains line voltage components, and the flow module is designed for area 3 as it contains only low-voltage DC components that will not cause life-threatening shocks/electrical hazards and is therefore safe to be used in a wet area.

Figure 2:
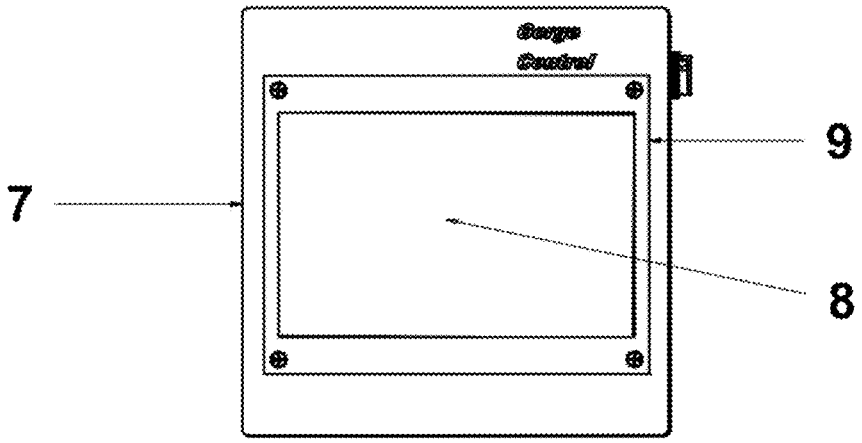
FIG. 2 shows the front view of the control module.

In FIG. 2 the front of the control module is shown. The touch screen 8 may be secured to the control case 7 by the touch screen mounting bracket 9 and may provide a user interface to view, change, control, log and monitor the way fluids are mixed and delivered.

Figure 3:
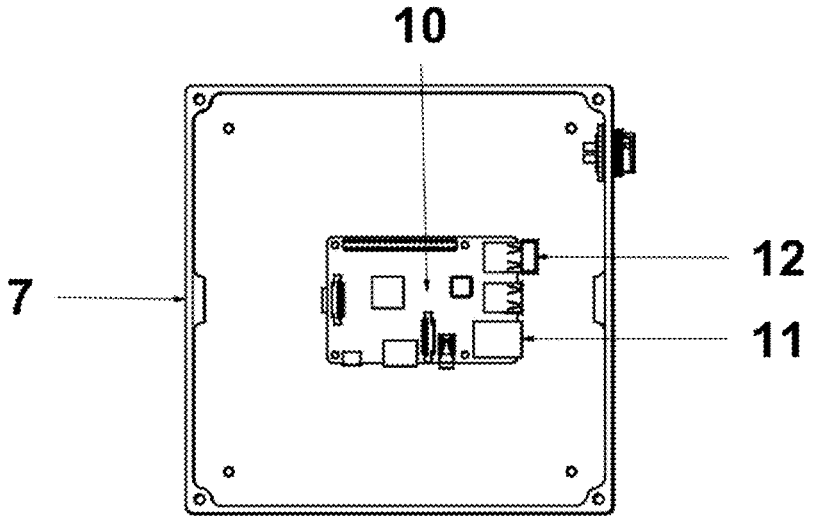
FIG. 3 shows the internal view of the control module.

In FIG. 3 the inside of the control module is shown. The various components that may play a role in the function of the device within the casing 7 are the motherboard with CPU 310, its wired ethernet connector 11, and its wifi ethernet interface 12.

Figure 4:
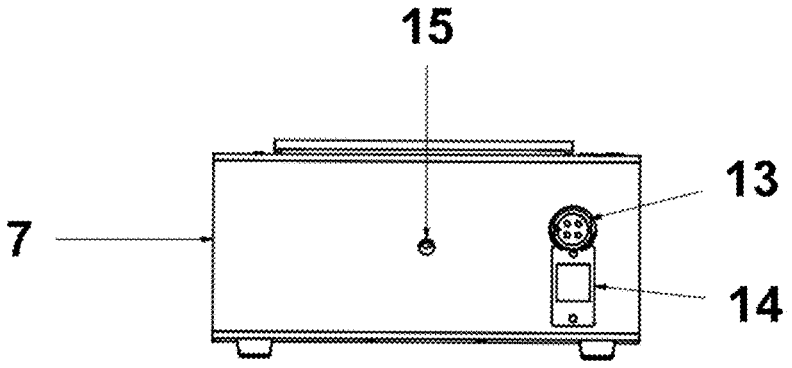
FIG. 4 shows the right-side view of the control module.

In FIG. 4 the right-hand side of the control module is shown. The control module case 7 may obtain its power and communication facilities from the power module using the powcom cable which connects to 13, and may communicate via the internet using an internal wifi module or via a standard category 5 or category 6 cable connected to the Internet connector 14. The internet connector 14 may be used when the user desires a wired connection. The casing 7 may be "tilted" or "pitched" by being rotated along the user's YZ axis via the two holes 15 (one on either side of 7) which contain bolts that are connected to a yoke (not shown) which may provide rotational movement along the pitch axis. The rotational movement along the pitch axis may make it easier for the user to read the screen in varying light conditions.

Figure 5:
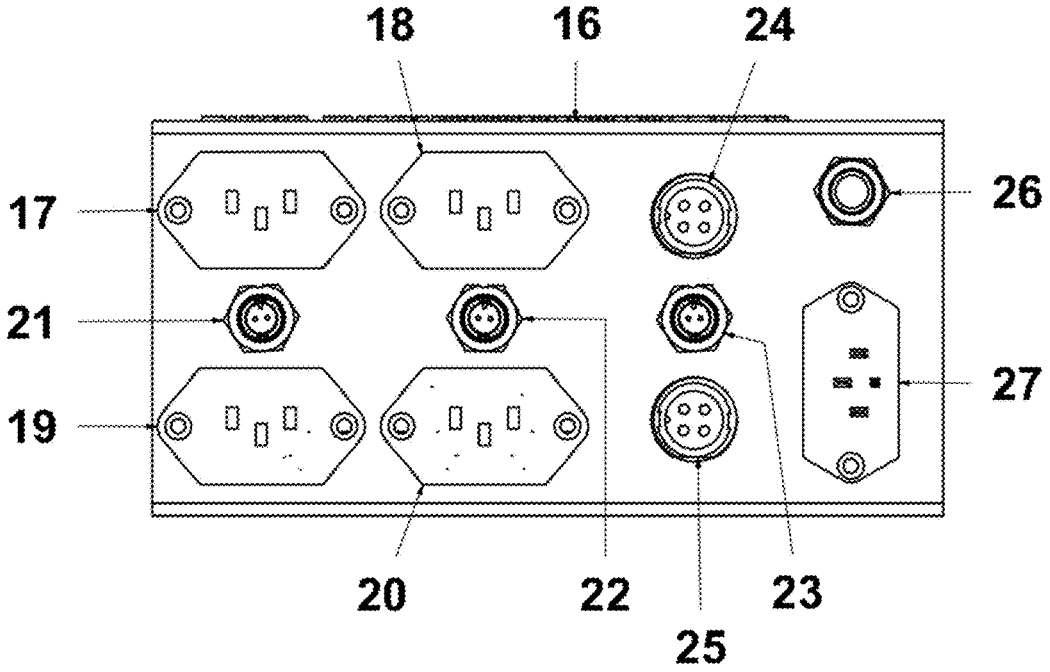
FIG. 5 shows the bottom view of the power module.

In FIG. 5 the bottom side of the power module is shown. In embodiments, the various components that play a role in the function of the power module may be mounted on or inside the casing 16 and may include, for example, one or more of: the plurality of female IEC connectors 17 18 19 and 20, the plurality of low-voltage DC connectors for the base fluid input/output solenoid-controlled valves 21 22 and 23, the plurality of powcom connectors 24 and 25, a circuit breaker reset button 26 and the male line-voltage input IEC connector 27. Female IEC connector 17 may be connected to a mixing pump housed within the tank, female IEC connector 18 may be connected to any output feed pump which may be used (typically in non-gravity-feed installations), female IEC connector 19 may be connected to a heating element housed within the tank, and female IEC connector 20 may be connected to any aerator unit (typically used for oxygenated feeds) that may be used and housed within the tank. Solenoid connector 21 may supply switched 12 VDC to the solenoid that controls the refilling of the tank with the base liquid, solenoid connector 22 may supply switched 12 VDC to the solenoid that controls the outputting of the mixed fluid for usability ("Feed"), and solenoid connector 23 may control the outputting of the mixed fluid into a suitable wastewater facility ("Flush"). Powcom connector 24 may supply powcom to the control module, and powcom connector 25 may supply powcom to the flow module. The circuit breaker reset button 26 may be used in the event of device overload, circuit, or power issues, and the male IEC connector 27 may be connected to a power cable which supplies line voltage into the power module.

Figure 6:
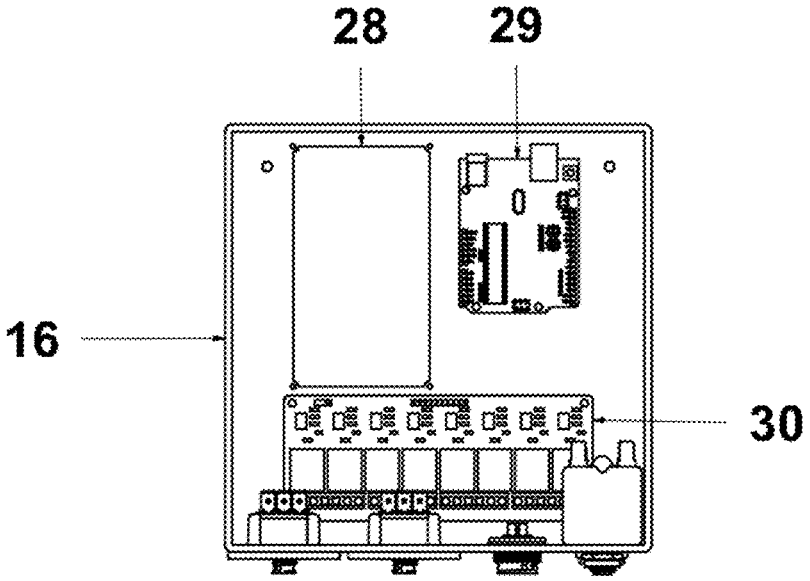
FIG. 6 shows the internal view of the power module.

In FIG. 6 the major components of the power module are shown. The casing 16 contains the connectors described above In FIG. 5 as well as the power supply 28, the power module CPU 29, and the relay block 30 that opens and closes the relays to turn on and off the various line-voltage equipment.

Figure 7:
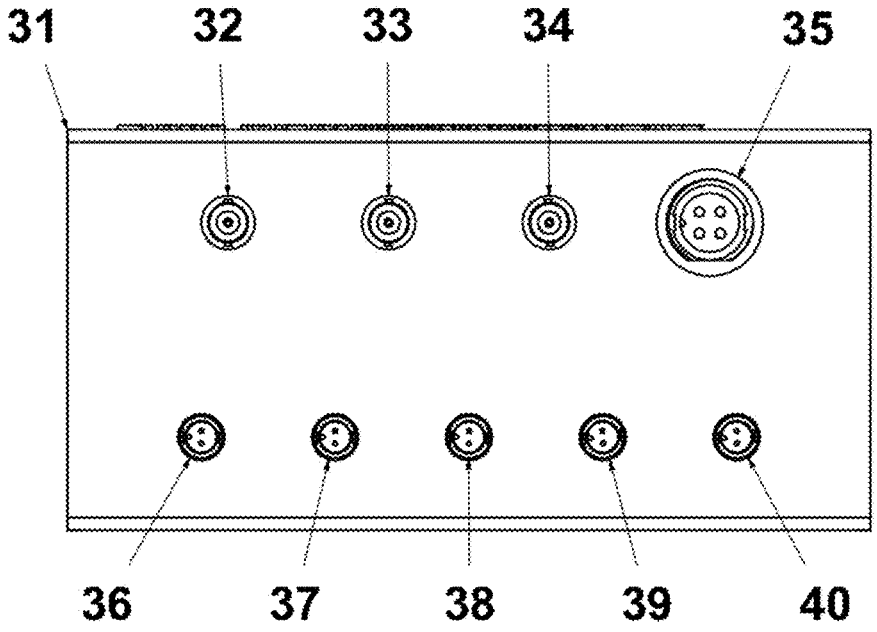
FIG. 7 shows the bottom view of the flow module.

In FIG. 7 the bottom side of the flow module is shown. The casing 31 contains a plurality of coaxial two-conductor connectors 32 33 and 34: 32 may connect to the water temperature sensor, 33 may connect to the water level sensor, and 34 may connect to the pH sensor. The casing 31 may also contain the multiconductor powcom connector 35, as well as the two-wire connectors for the solenoid-controlled valves of each of the fluid-holding bins. In the particular embodiment shown, five bins are being controlled: 36 may connect to bin 5, 37 may connect to bin 4, 38 may connect to bin 3, 39 may connect to bin 2, and 10 may connect to bin 1. The two-conductor bin connectors 36 37 38 39 10 are reverse-ordered as the flow module sits on the back of the mixing bracket and thus bins numbered left-to-right on the front of the mixing bracket are numbered right-to-left when viewed from the back of the mixing bracket.

Figure 8:
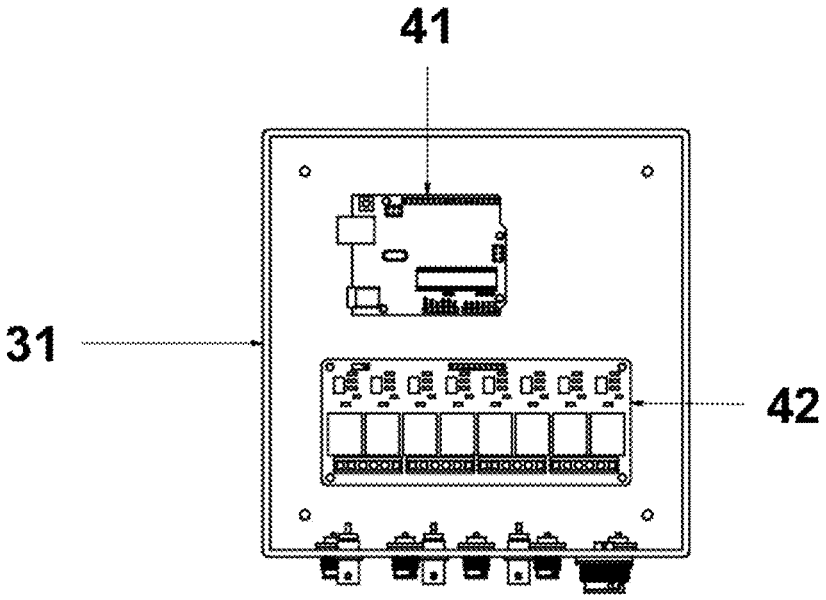
FIG. 8 shows the internal view of the flow module.

In FIG. 8 the major components of the flow module are shown. The casing 31 may contain the CPU 41 and the relay block 42 which may supply power for the opening and closing of the bins. Embodiments of the flow module may have more than five bins for more complex mixing operations.

Figure 9:
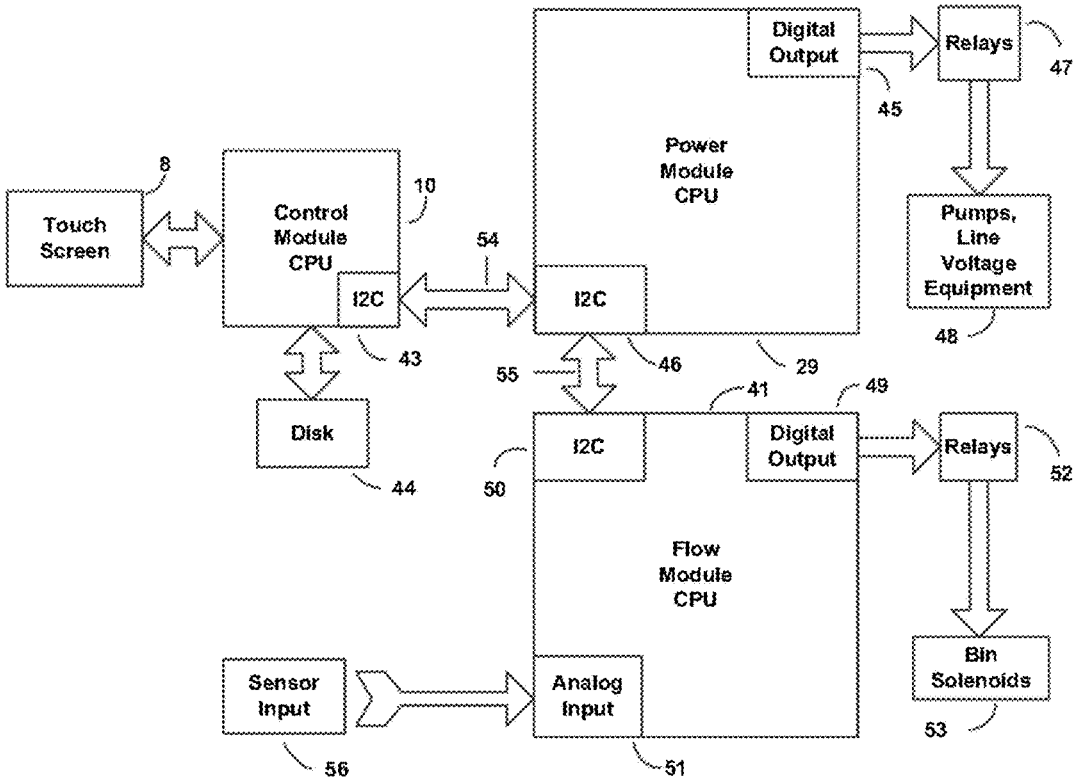
FIG. 9 shows the major electric and electronic components of the device and how they communicate.

In FIG. 9, the internal communications between modules is shown. When the user makes choices they enter the values on the control module's touch screen 8 which may communicate them to the control module CPU 10. The program code running on the control module CPU 10 may save these changes to disk 44 and may send any commands or communication necessary via its I2C interface 43 and the powcom cable 54 to the power module's I2C interface 46 which either:

(a) for commands and communication affecting equipment hooked up to the power module, may process them and may manage the equipment hooked up to the power module 48 via the relays 47 controlled using the power module's digital output 45; or (b) for commands and communication affecting equipment hooked up to the flow modle, may forward them to the code running on the flow module CPU 41 via the powcom cable and serial interfaces 46 55 and 50. The code running on the CPU 41 in the flow module may then read the input sensors 56, or may send commands to the solenoid-controlled valves 53 for the bins. When the code running on the CPU 41 in the flow module has finished all requisite processing for the command(s) it received, it may respond by sending data and command responses via the powcom cable 55 and associated serial interfaces 50 46 to the power module's CPU 29. If the command was initiated from the control module, the power module may forward the flow module responses to the control module via the I2C interface: powcom combination 46 54 and 43.

Figure 10:
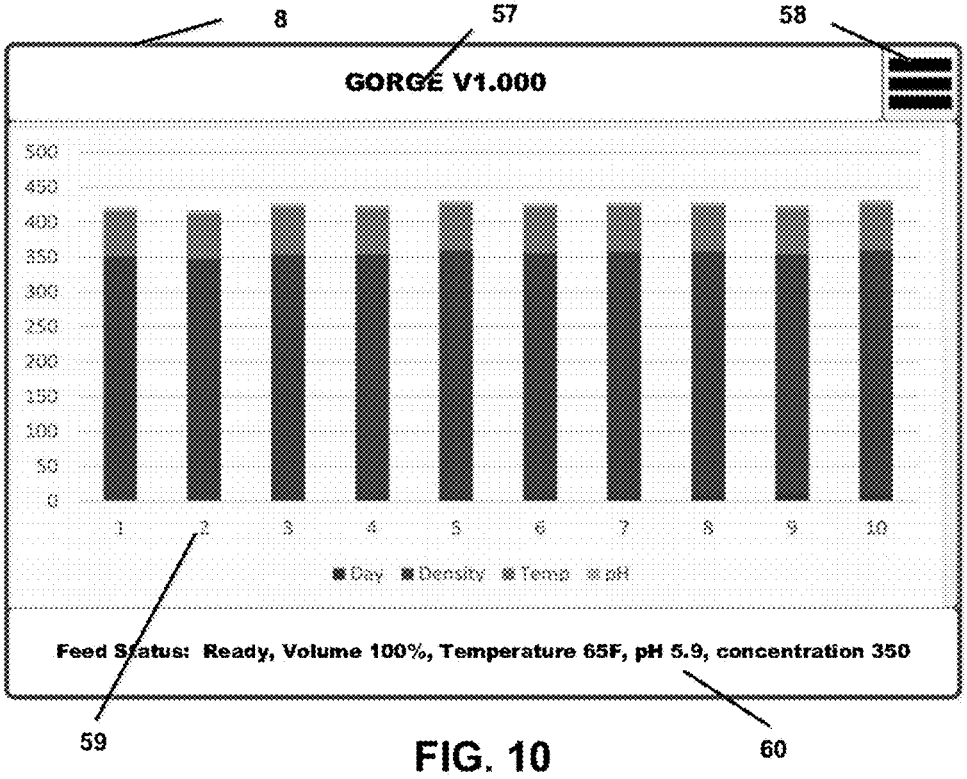
FIG. 10 shows the initial/top display of the program running in the control module CPU.

In FIG. 10, the program's "top level" display is shown displayed on the touch screen 8. This may be presented to the user after power on if setup is complete, and this may be the display from which the user can view the results of their mixing process(es). The product name may be displayed in the header bar 57. The three bars in the upper right-hand corner 58 may be the icon for the Main Menu. The vertical bars 59 may display the results of the previous mixing process(es), with the Density, Temperature, and pH of the mixed fluid clearly shown. The status bar 60 may show the status of the mixed fluid; in FIG. 10, it is ready to be fed, the mixed fluid comprises 100% of tank capacity, the temperature of the mixed fluid is 65 F, the pH of the mixed fluid is 5.9, and the density/concentration is 350 ml/gallon.

To change the view the results of previous mixing processes, the user can pinch the display, which will zoom out the area that was pinched; or the user can stretch the display, which will zoom in the area that was stretched. The pinch and stretch gestures used are identical to pinch and stretch gestures used on tablet PC's.

Figure 11:
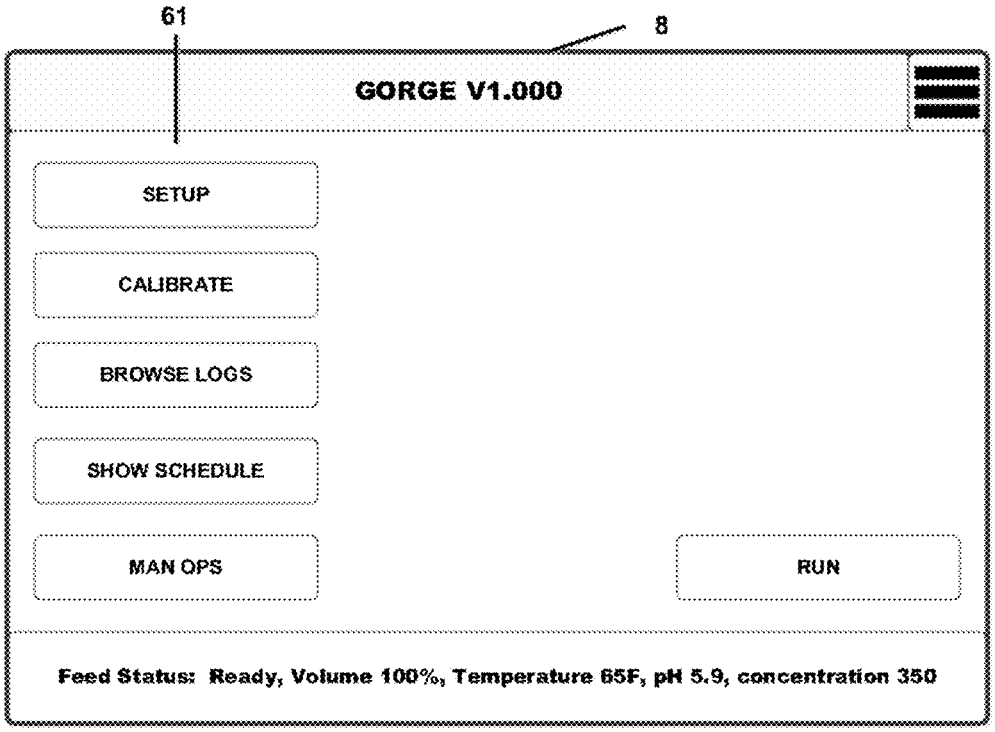
FIG. 11 shows the main menu of the program running in the control module CPU.

In FIG. 11, the program's main menu 61 that is viewable on the touch screen 8 is shown. This menu may be presented to the user when the user taps on the Main Menu icon (the three bars) in the upper right-hand corner of the touch screen 8. Once presented with the Main Menu, the user makes a choice by tapping the appropriate menu option. The available actions may include: Setup; Calibrate; Browse Logs; Show Schedule; Manual Operations; and Run.

If the user taps any menu option other than Run, the user may be presented with a menu for that option on the touch screen 8. If the user taps Run, the user exits from the Main Menu, and the user then sees the main display screen for the device, as shown In FIG. 10.

Figure 12:
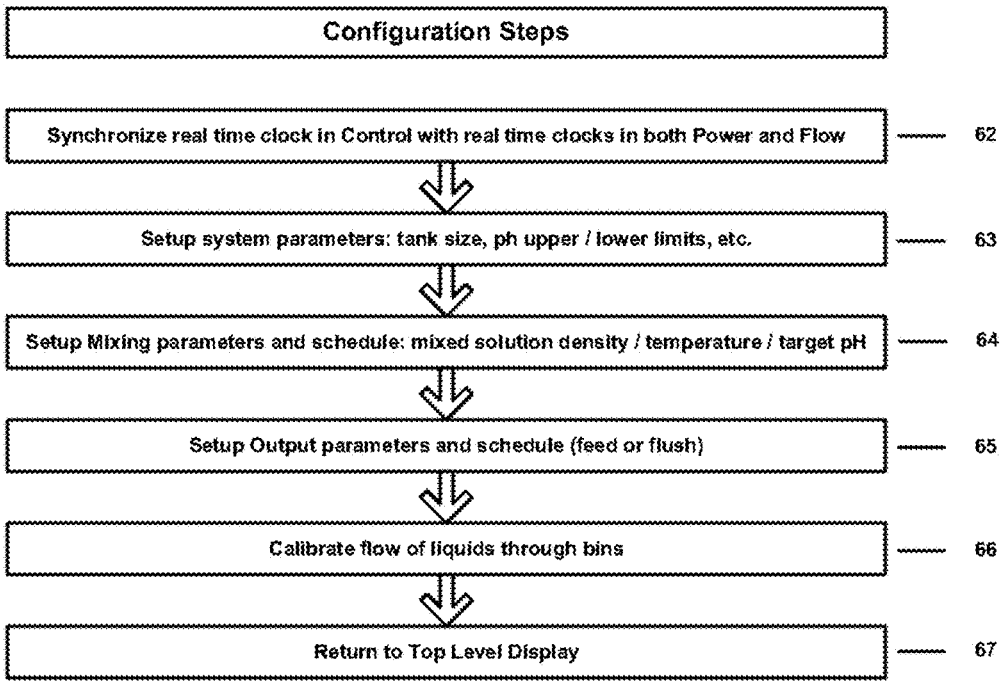
FIG. 12 shows the steps required for configuration of the device.

In FIG. 12, the program steps to validate the configuration are shown. After power on, the program may first determine the time and synchronize the CPU in the power module and the CPU in the flow module via communications routed over the communications conductors in the multi-conductor power cable so all three modules share the same time setting 62. As the three modules are connected via serial communications using an electrical cable, any synchronization effort requires that both the power module and the flow module compensate for the signal delays experienced during inter-module communications. The compensation is the sum of the time it takes to transmit the number of bytes being transmitted plus the code overhead to create the communications data plus the code overhead to process the communications data and update the clock. Both modules may add this predetermined amount of time calculated during device manufacture to the incoming timestamp, and the result may be stamped into each CPU's real time clock. While the result cannot be made accurate to the microsecond due to the unknowns and vagaries of software path lengths, it is accurate to the millisecond, which is sufficient for solenoid-controlled valve timing.

The program may query internal non-volatile memory to inspect the system configuration, mixing schedule(s), and delivery schedule(s). If the configuration is not complete, the program may prompt the user with the thus-far-known system configuration information 63, mixing schedule information 64, and delivery schedule information 65 and may prompt the user to optionally change what portions of the above are known and may force the user to complete the remainder of the schedule using the Setup menu option from the main menu 61 displayed on touch screen 8.

Once the system parameters, mixing parameters and schedule, and output parameters and schedule are complete, the user may be prompted to calibrate the system 66. After calibration, the system is setup and ready for use, so the user exits back to the top-level display 67.

Figure 13:
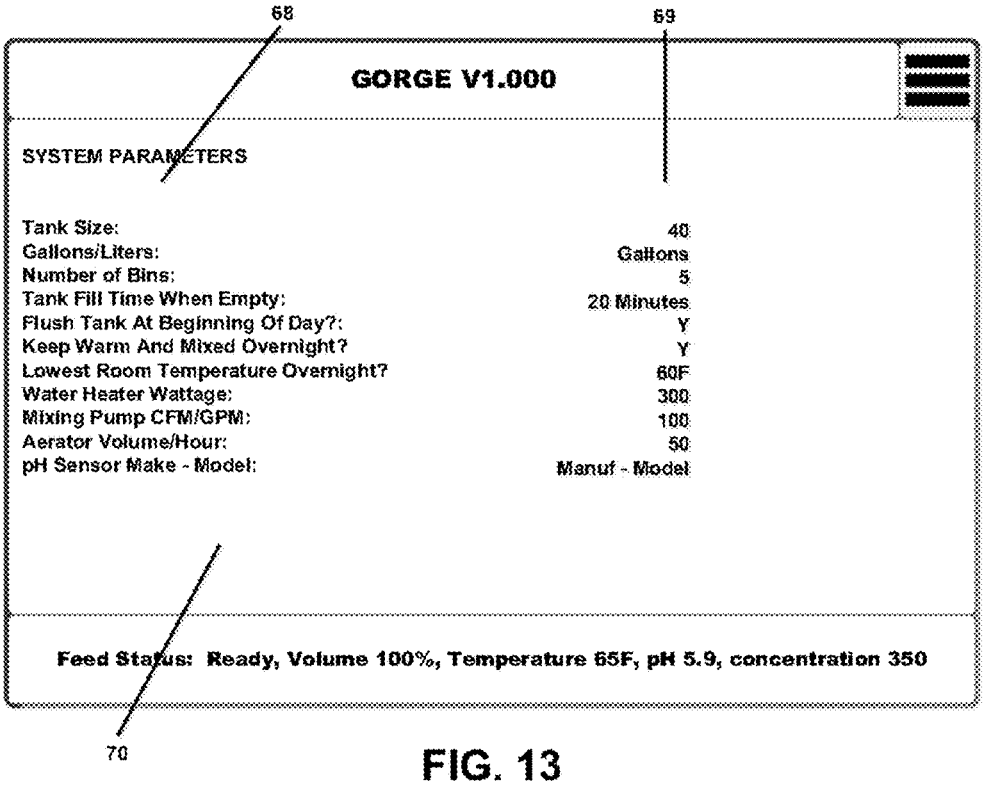
FIG. 13 shows the system parameter menu of the program running in the control module CPU.

In FIG. 13, the system configuration menu of the configuration program code is shown. The system configuration menu items 68 and their user-specified or system-defaulted values 69 specify items in the system configuration parameter area 70 that will not normally change as schedules change, possibly including: the size of the tank; the number of bins that contain injectable fluid; the amount of time in minutes to fill the tank; whether to flush the tank at the beginning of the next day; whether the user wants to run certain gear overnight such as the tank heater and mixing pump or whether the user wants to shut these off and restart them the next morning before the first mixing/delivery schedules begin; the lowest indoor air temperature overnight; the tank heater wattage; the mixing pump rating in cubic feet or gallons per minute; the aerator rating in volume per hour; and the pH sensor brand and model.

The ability to change the pH sensor brand and model is provided in the event the user prefers to use their own pH sensor, for larger or custom embodiments.

Once the system configuration process is complete the user may be prompted to calibrate the system. Calibration may be a required step as the liquids being mixed may have varying viscosities and thus the ability of the fluids being mixed to flow may need to be measured over time to understand the amount of time the mixing process(es) will require before mixing can begin.

Figure 14:
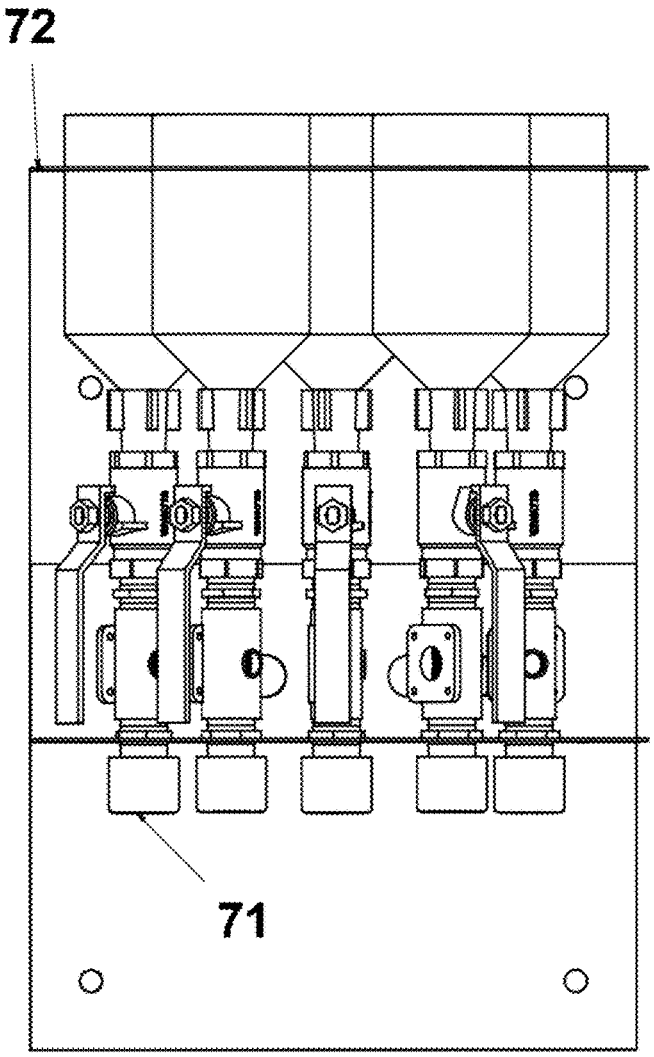
FIG. 14 shows the flow bracket with five bins installed.

In FIG. 14, the flow bins are shown. The flow module may be mounted on the back of the flow bins support bracket 72. The calibration menu solenoid-controlled valves mounted on the flow bins have a finite capacity to pass fluid. Since different fluids have different densities and viscosities, the finite capacity solenoid-controlled valves have different capacities to pass the actual fluids being used. What remains is for the user to calibrate the device to the density and viscosity of the fluids being used. The calibration process has the device actually pass the fluids from the bin being measured 71 into a measuring instrument until the measuring instrument is half-full at which time the user examines the measuring instrument and using the touch screen 8 the user may enter the amount of liquid that was actually injected into the measuring instrument. The flow module may subtract the starting timestamp of the liquid's flow from the ending timestamp of the liquid's flow and thus is able to calculate how much time elapsed for the user-entered amount of liquid to flow from the bin. In this manner the device may be able to understand how much time it will take to actually inject a given amount of fluid. This process is repeated for each fluid being injected into the base fluid during the mixing schedule.

The user may begin the calibration process by emptying the tank 5 and filling the bin being calibrated 1471 with the fluid being injected into the base solution. For each bin being calibrated, the user may place a beaker or other receptacle calibrated in milliliters under the output pipe of the bin being calibrated and may press a start/stop button on the calibration menu. The device may open the solenoid-controlled valve for the bin being calibrated and the fluid being injected may begin filling the beaker. When the beaker is approximately 50% full, the user may again press the start/stop button. The user may then visually inspect the beaker to get a reading of how many milliliters were injected into the calibrated receptacle, and the user may enter that on the touch screen 8. The calibration process program code may prompt the user to return the contents of the calibrated receptacle to the bin, and may ask the user to repeat the process in which case the device may open and close the solenoid-controlled valve in short bursts to better understand the flow rate of the fluid being injected. The calibration process may also ask the user to validate each of the doses contained in the mixing schedule by automatically measuring out the dose and prompting the user to validate the amount of the dose.

When the measurement for a given bin is complete, the user may be prompted to rinse out the calibrated receptacle and the process may repeat with the next bin.

Once the calibration process is complete the device may inspect the mixing and delivery schedules and the user may be prompted to complete, change or accept the mixing and delivery schedule(s).

Figure 15:
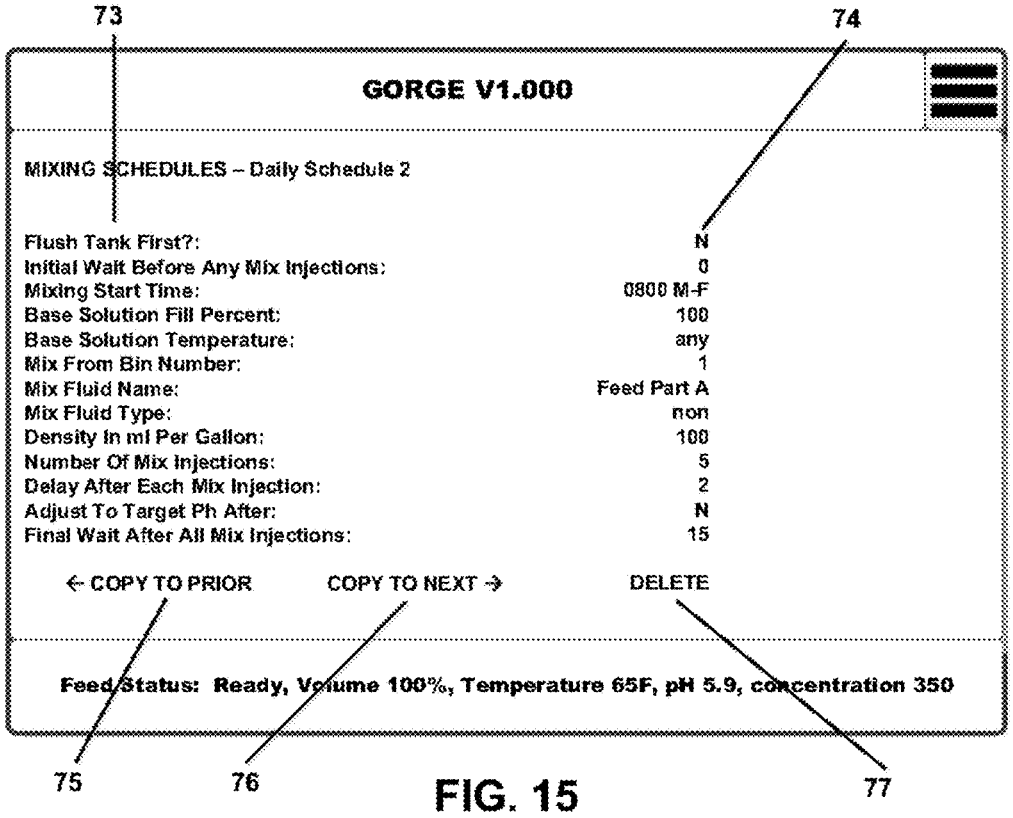
FIG. 15 shows a mixing parameter menu of the program running in the control module CPU.

In FIG. 15, the mixing schedule configuration menu of the configuration program code is shown. Mixing schedule information 73 74 may include: an option to flush the tank before mixing; the start time of the mixing process; waiting a prespecified time before the mixing process begins; target base solution level expressed as a percent of tank capacity (1-100); the base solution temperature desired; the bin number of the fluid being mixed into the base solution; the name of the fluid being mixed in; the type of fluid being mixed in: pH up fluid; pH down fluid; or a non-pH adjusting fluid; for non-pH adjusting fluids, the density of the fluid in milliliters per gallon or milliliters per liter depending upon whether the tank is denominated in gallons or liters; the number of mixing injections for this fluid into the base mixture; a 0-99 minute time delay after each injection; whether or not the target pH of the base solution should be adjusted to a given pH after the fluid has been mixed into it; and whether or not to wait after this mixing process has been completed before continuing with other mixing/outputting tasks.

The device calculates the end time of the mixing process as:

$$endTime=ST+PHT+DT+MT+PHBT+WT$$

Equation 1: calculation of mixing process end time where:

ST ("start time") is the start time of the mixing process;

PHT ("pre-heating time") is the time required to heat the tank to the desired temperature based on the current or lowest-overnight-temperature and the tank heater wattage;

DT ("dispensing time") is the time estimated by the device that will be required to inject the desired number of milliliters of the fluid;

MT ("mixing time") is the time required to mix x milliliters of the fluid including any optional 0-99 minute time delay after each injection;

PHBT ("pH balancing time") is a device-generated estimate of the amount of time it will take the system to balance the pH of the fluid; and WT ("post-mix wait time") is the time specified by the user to wait after the mixing process is complete before other mixing/feed processes continue.

Users will note that pH balancing time may change as the system accumulates history balancing the pH. The device may use heuristics to calculate the pH balancing time variable, and if so, then each time the pH is balanced, the internal value of this variable may change from what the user specified using a weighted averaging methodology.

For each mixing schedule entered, if there is more than one mixing schedule, the user may be presented with copy forwards 75 and copy backwards 76 buttons based on this algorithm:

If there are 2-n mixing schedules, and if the user is not configuring the first mixing schedule, a 'copy backwards' button is presented to copy all of the mixing schedule information shown except the start time to the prior mixing schedule. For example, if the user is on the third mixing schedule, using the 'copy backwards' button the user may overwrite every parameter in the second mixing schedule with the information in the third mixing schedule, with the exception of the start time.

If there are 2-n mixing schedules, and if the user is not configuring the nth (last) mixing schedule, a 'copy forwards' button is presented to copy all of the mixing schedule information shown except the start time to the next mixing schedule. For example, if the user is on the third mixing schedule, using the 'copy forwards' button the user may overwrite every parameter in the fourth mixing schedule with the information in the third mixing schedule, with the exception of the start time.

The 'copy forward'/'copy backward' feature of the device makes it easy to copy multiple identical processes. If the user is desirous of creating four mixing schedules that are all identical save the exception of the start time, the user may press the 'copy forward' button to copy the first mixing schedule to the second; when finished with the first mixing schedule the user only needs to enter the start time of the second mixing schedule and press the 'copy forward' button; then they're done with the second and may repeat the steps listed herein for the third and fourth mixing schedule. This saves the user time and ensures all four mixing schedules are identical except for the start time.

The user may also be presented with a 'delete' button 77, so that the user can easily remove unwanted mixing schedules.

Figure 16:
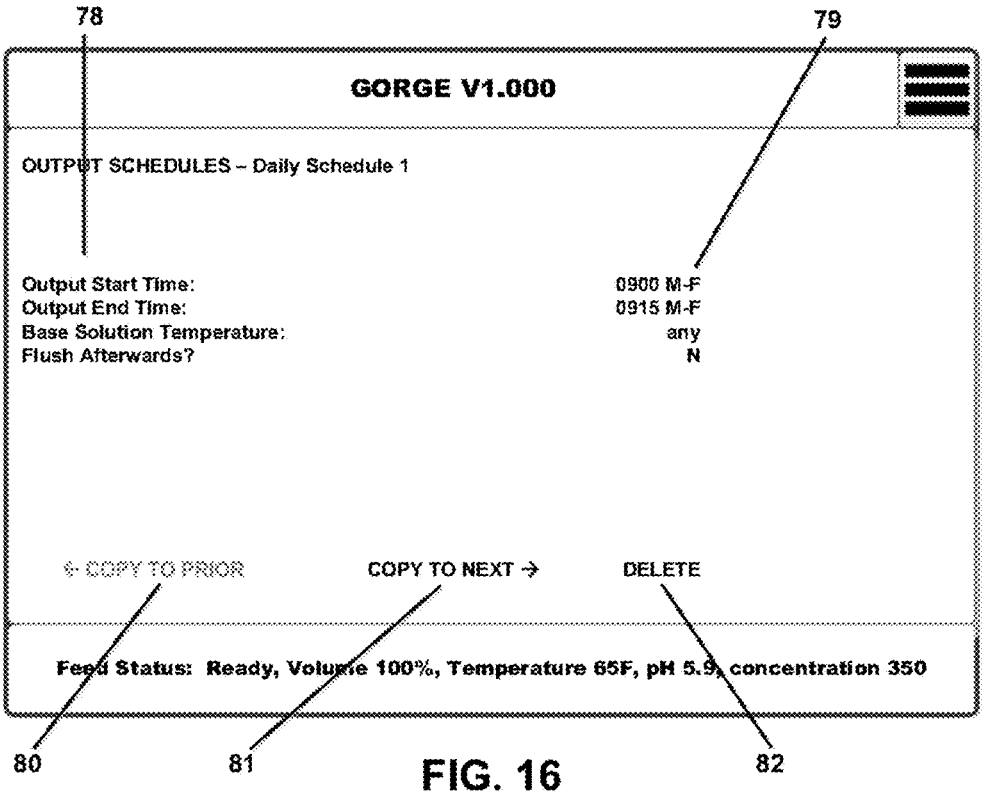
FIG. 16 shows an output parameter of the program running in the control module CPU.

In FIG. 16, the output schedule configuration menu of the configuration program code is shown. Output schedule variables 78 and their values 79 consist of the start time and end time of the output process for each output schedule, as well as the pH limits (low and high) for the mixed fluid. If the pH of the mixed fluid does not fall within the pH limits, the user may be notified via email and/or SMS text messages for manual correction.

In a like manner to the mixing configuration menu in FIG. 16, the output schedule configuration menu has copy backwards 80, copy forwards 81, and delete 82 buttons for managing multiple output schedules.

Figure 17:
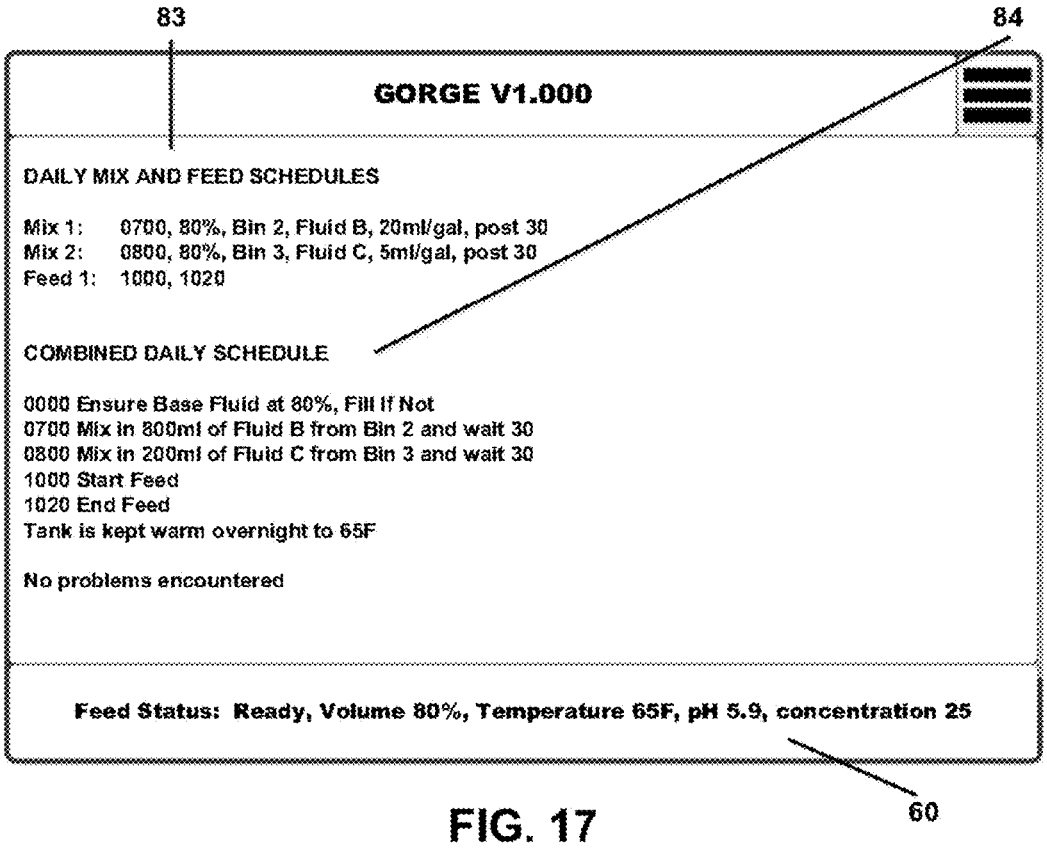
FIG. 17 shows the serialized output screen of the program running in the control module CPU where the mixing and output schedules are combined chronologically over time.

In FIG. 17, the combination of an example of daily mixing and output schedules 83 is shown as a serialized daily schedule 84. The device has been told to maintain the tank temperature overnight, so the day begins at 07:00 am by filling the 50 gallon tank to 80%, mixing the liquid from bin 2 into the tank at a rate of 20 ml per gallon, waiting 30 minutes, mixing the liquid from bin 3 into the tank at a rate of 5 ml per gallon, waiting 30 minutes, adjusting the pH, then delivering the mixed fluid beginning at 10:00 am ending at 10:20 am.

The device indicates that there are no problems adhering to that schedule, and the status bar 60 reflects the current state of the tank. In the figure shown, since we mixed 800 ml from Bin 2 and 200 ml from Bin 3 in to a 50 gallon tank that is 80% full, the status bar indicates a density of:

$$(800+200)/(50*0.8)=1000/40=25 \text{ ml/gal}$$

Figure 18:
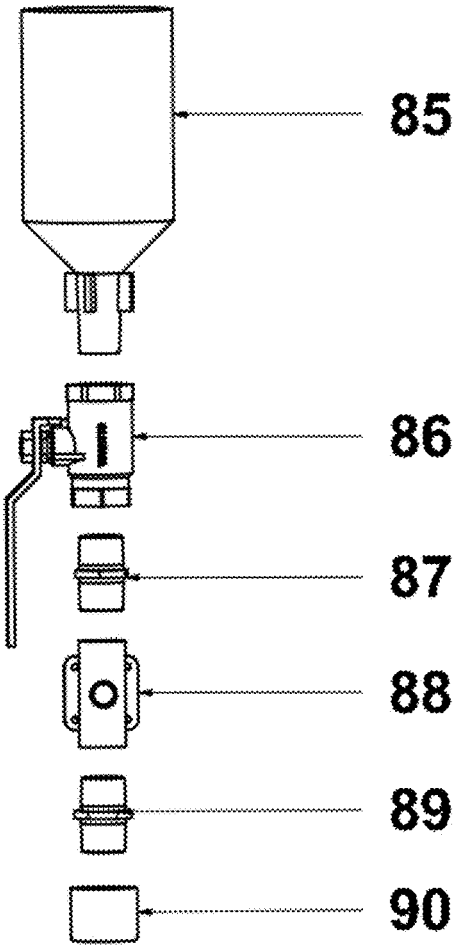
FIG. 18 shows the fluidic components of a mixing bin.

In FIG. 18, the components of each bin that contains fluid to be mixed are shown. The bin 85 stores the fluid to be mixed that may flow through the shutoff valve 86, the first union 87, the solenoid 88, the second union 89, and the spray/drain cap 90 when the microprocessor opens the solenoid valve. The first union 87 may be used to remove the bin 85 when cleaning or replacement is required. The second union 89 may be used when replacing, repairing or cleaning the solenoid valve 88. The spray/drain cap 90 may be used in the flush-back system as further explained below.

Figure 19:
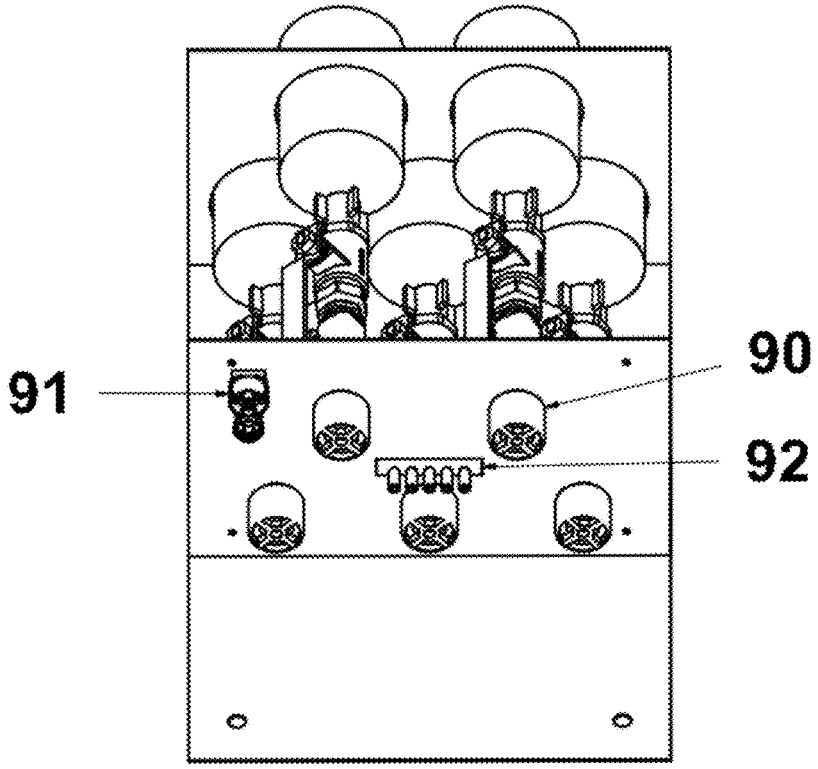
FIG. 19 shows the bottom of the flow bracket highlighting the flushing system components.

In FIG. 19, an embodiment of the flush-back system and components that may comprise it are shown. The flush-back system may use a flushing pump 91 that takes mixed fluid from the tank using a weighted flexible tube that may be immersed in the mixed fluid (not included in this patent application and not shown) and may pump it into the splitter 92 which may route it using piping (not included in this patent application and not shown) into each spray/drain cap 90 for each of the delivery tube assemblies as defined and as shown on FIG. 18, above. The flow of mixed fluid may be propelled into the output end of the delivery tube for each fluid up to the solenoid valve 88 which is closed and thus blocks further progress of the mixed fluid and then the mixed fluid drains back into the tank thus rinsing the delivery tube and ensuring the total measured dose of each fluid drains into the tank. This process may remove any liquids whose viscosity is such that some of the liquid in the bin which flowed through the delivery tube might remain in the delivery tube and thus may aid in the rapidity of the mixing process and resulting homogeneity of the mixed fluid.

In embodiments, the spray/drain cap 90 can be fashioned as a clip instead of a cap if the diameter of the output pipe is such that using a cap prevents fluid from flowing back into the tank 5 due to the density and viscosity of the fluids being mixed.

Figure 20:
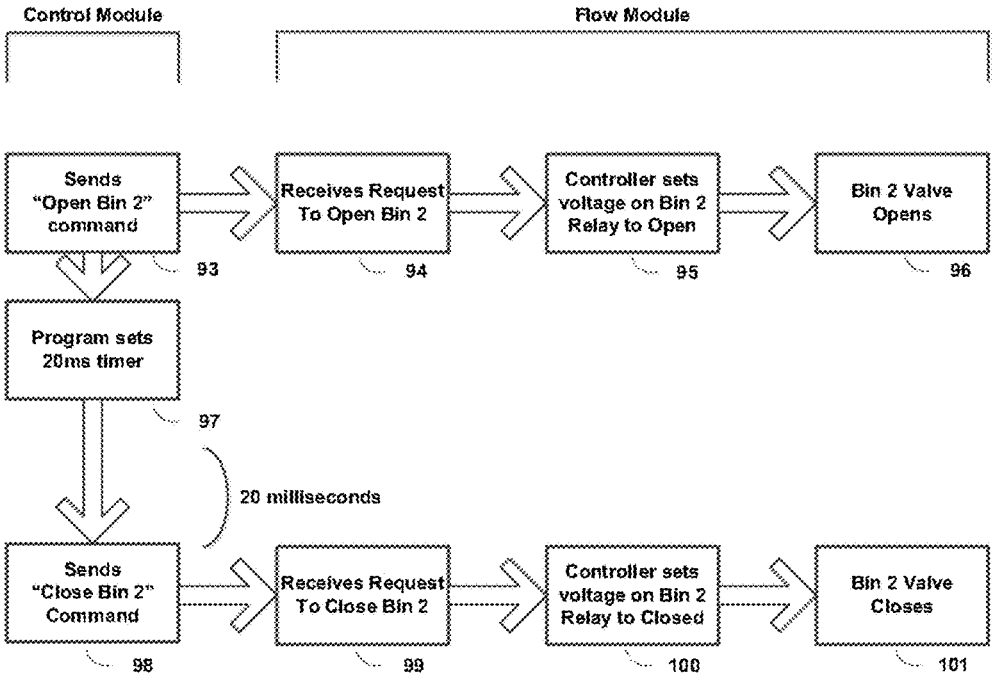
FIG. 20 shows the steps taken by the program running in the control module to feed liquid from bin number 2 for 20 milliseconds.

In FIG. 20, an example of the processing logic for opening a solenoid-controlled valve is shown. In the example shown, the control module program determines it needs to add some fluid from bin number 2 to the mixed fluid. Using the powcom to send and receive commands, the control module program issues a "Open Bin 2" command 93 to the flow module program that reads the sensors and opens and closes the solenoid valves. The flow module program receives the "Open Bin 2" command 94, sets the voltage on the solenoid relay for bin 2 to "open" 95 and the solenoid-controlled valve on Bin 2 opens 96.

The control module program may then set a 20 millisecond timer 97 that is designed to run when its time interval has elapsed. When the 20 milliseconds have expired, the control module programs' timer code may then issue a "Close Bin 2" command to the flow module 98. The flow module program receives the "Close Bin 2" command 99 then sets the voltage on the solenoid relay for bin 2 to "close" 100 and the solenoid-controlled valve on Bin 2 closes 101.

Figure 21:
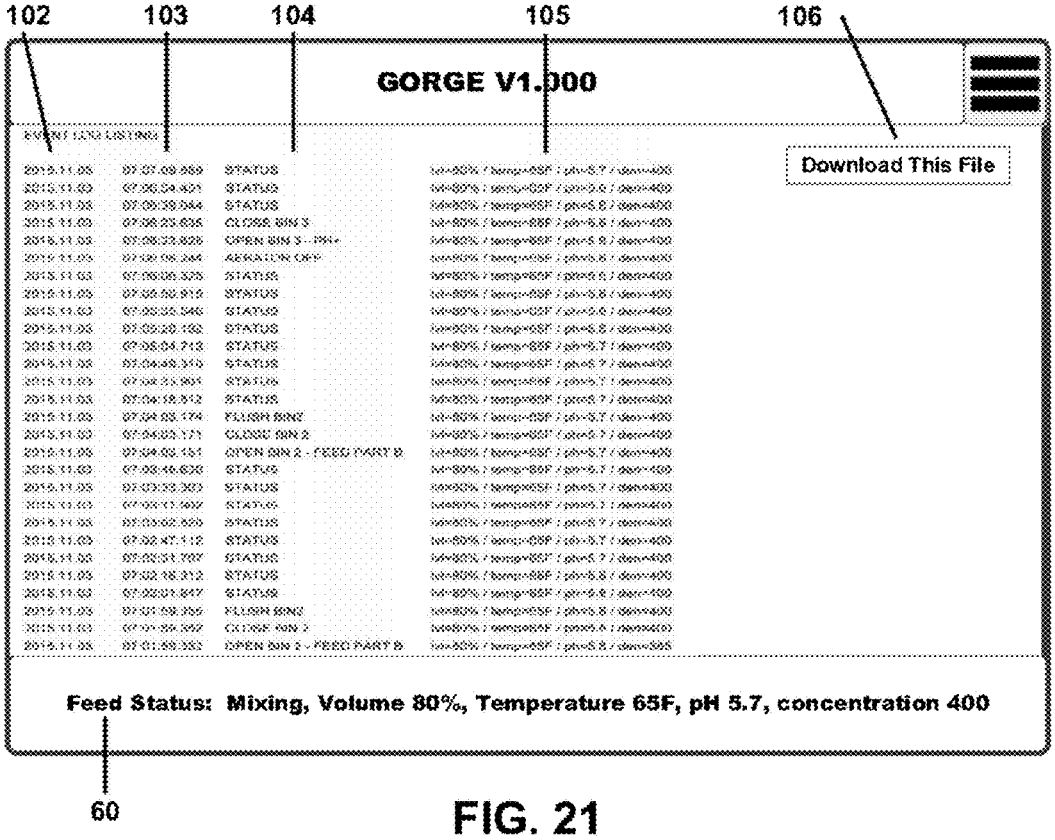
FIG. 21 shows a view of an event log while being browsed by the user on the control module's touch screen.

In FIG. 21, log information display generated by the device that may be viewable on a standard computer browser is shown. In the output shown, the date 102, time 103, action(s) taken 104, and status 105 of the device are shown. The latest status 105 should match the information shown in the device's status bar 60.

Log information may be shown as a sequential list of events ordered by decreasing date and time. The user can scroll up or down to display up-to-date (top) or past (lower) log information. By browsing the log information users can see what actions are being taken and in the event things go wrong the user can also answer "what happened when?" queries.

FIG. 21 also shows the download feature for downloading the event file in .zip file format 106. The 'download' button may only appear on browsers running on external computers; that is, computers that are browsing the device using the device's internet communications feature and industry-standard browsers. These external computers can be touch-enabled devices or mouse-enabled devices. The downloaded file may be in .csv format and can be used in spreadsheets or other csv-capable devices for downstream analysis. The 'download' button, while shown here for inclusiveness, is not visible on the device's touch screen 8 itself.

While the foregoing written description enables one of ordinary skill to make and use a device as described, those of ordinary skill will understand and appreciate the existence of variations, combinations, and equivalents of the specific embodiments, methods, and examples herein. The specification described here should therefore not be limited by the above described embodiments, methods, and examples, but by all embodiments and methods within the scope and spirit of the claims.

The invention claimed is:

1. A fluid mixing device, comprising:

a controller, including:

at least one processor;

at least one permanent storage medium;

at least one non-volatile memory;

at least one display;

at least one input device;

a non-volatile storage device that contains a log of the events that took place during the mixing of one or more fluids from liquid holding devices into one resultant liquid holding device; and program instructions stored in said non-volatile memory which when executed on said processor control the mixing of fluids from liquid holding devices into one resultant liquid holding device;

a power supply; and at least one fluid-holding bin, each of said at least one fluid-holding bin having at least one valve; and at least one flush-back system wherein said flush-back system flushes out the liquid delivery systems for each of said bins, wherein said flush-back system comprises a splitter; and a pump for pumping mixed fluid from the resultant liquid holding device to the splitter, for routing the pumped mixed fluid to a spray/drain cap for each of said at least one liquid delivery system.

2. The fluid mixer device of claim 1, wherein each of said at least one processor comprises one of:

a microprocessor;

a microcontroller; and a CPU.

3. The fluid mixer device of claim 1, further comprising at least one enclosure defining at least one interior space for receiving said processor and said permanent storage medium and said non-volatile memory and said display and said input device and said non-volatile storage device.

4. The fluid mixer device of claim 1, wherein said:

at least one processor;

at least one permanent storage medium;

at least one non-volatile memory;

at least one display; at least one input device; and non-volatile storage device are housed in separate compartments and communicate using at least one of electric and optical connections.

5. The fluid mixer device of claim 1, wherein said power supply comprises at least one of a battery and an external AC line power source.

6. The fluid mixer device of claim 1, wherein said device comprises one or more of:

at least one fluid level sensor and at least one temperature sensor and at least one pH sensor;

wherein said sensors are housed in one of the mixed fluid holding tank and the reservoir.

7. The fluid mixer device of claim 1, further comprising:

at least one heating element;

at least one fluid mixing motor; and at least one fluid aerator, wherein said device controls the power to:

said at least one heating element;

said at least one fluid mixing motor; and said at least one fluid aerator, and wherein said device controls the speed of said at least one mixing motor.

8. The fluid mixer device of claim 1, further comprising:

at least one mixed fluid holding tank containing a base fluid and at least one reservoir containing a base fluid;

wherein said device controls the flow of the fluid being mixed from said at least one holding bin into said base fluid in said holding tank and reservoir.

9. The fluid mixer device of claim 1, further comprising at least one of:

at least one input valve for controlling the inputting of the base fluid;

at least one output valve for delivering the resultant mixed fluid; and at least one output valve for removing the resultant mixed fluid.

10. The fluid mixer device of claim 1, further comprising at least one of:

at least one output feed pump; and at least one waste feed pump.

11. The liquid mixing device of claim 1, wherein said program code comprises program instructions for giving users the ability to:

view at least one of:

density;

temperature;

pH; and the fluid level of the resultant mixed liquid;

set up at least one mixing schedule;

set up at least one mixed fluid delivery schedule;

browse a log of the events that took place during the mixing of one or more fluids; and calibrate the system so as to properly control the flow of fluids of various viscosities.

12. The liquid mixing device of claim 1, wherein said program code comprises program instructions for controlling:

the volume of the base fluid;

the density of each said fluid being mixed into said mixed fluid;

the temperature of the base fluid;

the density of each fluid being mixed from the bins in the mixed fluid;

the pH of the base fluid;

the temperature of the mixed fluid;

the aeration of the mixed fluid; and the resultant pH of the mixed fluid.

13. The liquid mixing device of claim 1, wherein said program instructions comprise program instructions for:

mixing fluids from said at least one bin into said base fluid on a volumetric basis;

mixing fluids from said at least one bin into said base fluid on a chronological basis; and delaying the mixing of fluids from said at least one bin into said base fluid on a chronological basis.

* * * * *